US011139623B2

(12) United States Patent
Brhel

(10) Patent No.: US 11,139,623 B2
(45) Date of Patent: Oct. 5, 2021

(54) SPLICE CONNECTOR ASSEMBLY

(71) Applicant: Lear Corporation, Southfield, MI (US)

(72) Inventor: Michal Brhel, Nový Poddvorov (CZ)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/742,460

(22) Filed: Jan. 14, 2020

(65) Prior Publication Data

US 2021/0218204 A1 Jul. 15, 2021

(51) Int. Cl.

| | |
|---|---|
| ***H01R 25/00*** | (2006.01) |
| ***H01R 25/16*** | (2006.01) |
| ***H01R 13/11*** | (2006.01) |
| ***H01R 13/506*** | (2006.01) |

(52) U.S. Cl.

CPC ..... *H01R 25/161* (2013.01); *H01R 13/113* (2013.01); *H01R 13/506* (2013.01)

(58) Field of Classification Search

CPC ... H01R 13/506; H01R 13/113; H01R 25/161
USPC ..... 439/114
See application file for complete search history.

(56) References Cited

U.S. PATENT DOCUMENTS 2,318,860 A * 5/1943 Huguelet ..... H02B 1/00 439/114
2,495,280 A * 1/1950 Joseph ..... H01R 25/161 174/116
2,522,672 A * 9/1950 Graham ..... H01R 13/28 403/326
3,197,729 A * 7/1965 Sarazen ..... H01R 11/20 439/422
4,146,285 A * 3/1979 Cook ..... H01R 25/16 439/213
4,965,928 A * 10/1990 Verge ..... H01R 43/20 29/742
5,201,667 A * 4/1993 Endo ..... H01R 13/5205 439/189
5,626,492 A * 5/1997 Onizuka ..... H01R 9/2458 29/876
5,630,273 A * 5/1997 Kobayashi ..... H01R 43/20 269/903
5,762,516 A * 6/1998 Itoga ..... H01R 4/2429 439/404

(Continued)

*Primary Examiner* — Abdullah A Riyami
*Assistant Examiner* — Vladimir Imas
(74) *Attorney, Agent, or Firm* — MacMillan, Sobanski & Todd, LLC

(57) ABSTRACT

A splice connector assembly includes a housing and a flat bus plate. The housing has openings on opposed end walls defining an axis being generally perpendicular to the opposed end walls. The flat bus plate is disposed within the housing, including a connecting strip extending generally perpendicular to the axis, a first set of male terminals extending outwardly from the connecting strip generally parallel to the axis, and a second set of male terminals extending outward from the connecting strip generally parallel to the axis and in an opposite direction from the first set of male terminals, wherein a free end of each of the male terminals are configured to receive and electrically connect with female flat terminals, and wherein the female flat terminals extend into the housing to connect to the male terminals through the openings on the opposed end walls.

15 Claims, 4 Drawing Sheets

(56) References Cited

U.S. PATENT DOCUMENTS 5,785,542 A * 7/1998 Johnson ..... H01R 25/162 439/210
5,888,095 A * 3/1999 Hussaini ..... H01R 9/0503 439/584
5,902,147 A * 5/1999 Jochen ..... H01R 12/675 439/405
5,975,936 A * 11/1999 Lin ..... H01R 24/64 439/344
6,093,041 A * 7/2000 Kay ..... H01R 31/085 439/225
6,168,455 B1 * 1/2001 Hussaini ..... H01R 9/0503 439/394
6,280,253 B1 * 8/2001 Kraus ..... H01R 9/2458 439/594
6,283,769 B1 * 9/2001 Asao ..... H01R 9/2466 439/74
6,299,469 B1 * 10/2001 Glovatsky ..... F02D 9/02 439/329
6,398,580 B2 * 6/2002 Lin ..... H01R 4/245 439/402
6,402,569 B1 * 6/2002 Spadoni ..... H01R 9/2466 439/723
6,707,689 B2 * 3/2004 Momota ..... H01R 9/226 174/72 A
6,780,044 B1 * 8/2004 Sawyer ..... H01R 4/2433 200/61.62
6,811,428 B1 * 11/2004 Sawyer ..... H01R 4/2433 439/403
6,905,346 B2 * 6/2005 Momota ..... H01R 9/226 361/833
7,001,187 B2 * 2/2006 Terunuma ..... H01R 9/226 439/76.2
7,134,905 B1 * 11/2006 Kamath ..... H01R 9/2466 439/417
7,332,674 B2 * 2/2008 Peterson ..... H01R 4/185 174/74 R
7,351,085 B2 * 4/2008 Tamagawa ..... H01R 12/592 439/189
7,476,113 B2 * 1/2009 Tamagawa ..... H01R 12/592 439/189
7,980,872 B1 * 7/2011 Smutny ..... H01R 31/085 439/189
9,190,791 B1 * 11/2015 Jaena ..... H01R 13/187
9,401,555 B2 * 7/2016 Smith ..... H01R 12/78
9,520,703 B2 * 12/2016 Jaena ..... H01R 25/162
9,698,548 B2 * 7/2017 Jaena ..... H01R 25/145
10,020,622 B2 * 7/2018 Ebisawa ..... H01R 25/162
10,164,366 B2 * 12/2018 Kataoka ..... H01R 13/113
2004/0137792 A1 * 7/2004 Matsumura ..... H01H 85/044 439/630
2012/0148910 A1 * 6/2012 Kambayashi ..... H01M 2/06 429/179
2012/0225582 A1 9/2012 Smutny et al.
2014/0287621 A1 9/2014 Smutny et al.
2015/0207128 A1 * 7/2015 Tsunaki ..... H01M 10/0413 429/179
2018/0277969 A1 * 9/2018 Yaita ..... H01R 9/2683
2019/0157649 A1 * 5/2019 Oshima ..... H01B 7/08

* cited by examiner

SPLICE CONNECTOR ASSEMBLY

BACKGROUND OF THE INVENTION

This invention relates to a splice connector assembly, especially for use in vehicle applications.

In vehicle applications, where weight and space constraints are at a premium, many vehicles utilize specially designed splice connectors or other forms of connectors to reduce the number of wires and electrical connectors that must be present. The use of such specially designed connectors, while beneficial to create a more compact solution, often result in higher research and manufacturing costs due to the quantity and complexity of the individual parts needed for each specific splice connector application. In addition, each application generally presents unique sizing and connector requirements which may prevent a more versatile design. Accordingly, there is a need for a splice connector with a compact, versatile shape and which may accommodate a variety of connector requirement combinations.

SUMMARY OF THE INVENTION

According to a first aspect, the invention provides a splice connector assembly that includes a generally rectangular housing. The housing includes an opening on opposing end walls. The splice connector assembly also includes a flat, generally H-shaped bus plate disposed within the housing, wherein the bus plate includes a connecting strip and at least two parallel male terminals extending outwardly from the connecting strip. The distal end of the at least two parallel male terminals are configured to receive and electrically connect with respective ones of at least two female terminals. The female terminals extend into the housing to connect to the male terminals through the openings on the opposed end walls. The housing may include an upper portion and a mating lower portion that cumulatively form the generally rectangular housing. The lower portion may include at least one upwardly extending positioning stud that is configured to be received within an aperture in the bus plate to position the bus plate within the housing. The connecting strip of the bus plate may include at least one aperture that is configured to receive the upwardly extending positioning stud. The at least two male terminals of the bus plate are spaced such that each male terminal can receive and electrically connect with one female terminal, or such that two adjacent male terminals can receive and electrically connect with one female terminal together.

In some embodiments, the bus plate is a six-way bus plate, such that bus plate includes six male terminals that are configured to receive and electrically connect with at least two female terminals, wherein the female terminals extend into the housing to connect to the male terminals through the opening on each end wall. Alternatively, in other embodiments, the bus plate is a twelve-way bus plate, such that the bus plate includes six male terminals that are configured to receive and electrically connect with at least two female terminals, wherein the female terminals extend into the housing to connect to the male terminals through the opening on each end wall.

According to another aspect, the invention provides a splice connector assembly that which includes a generally rectangular, electrically insulated housing, wherein the housing includes an opening on opposed end walls. The housing further includes an upper housing portion and a lower housing portion. The splice connector assembly also includes a flat, electrically conductive bus plate received within a cavity of the housing. The bus plate includes a connecting strip having at least one aperture and a plurality of axially extending, parallel male terminals extending from each side of the connecting strip. The male terminals are configured to engage with female terminals that enter the housing through the opening on the opposed end walls.

According to another aspect, the invention provides a bus plate that includes a connecting strip that extends perpendicular to an axis and at least two parallel male terminals extending outwardly along the axis from each longitudinal side of the connecting strip. The distal end of each male terminal is configured to receive and electrically connect with a female terminal. The bus plate also includes at least one third male terminal that is parallel to and spaced apart from the at least two parallel male terminals, wherein the distal end of the at least one third male terminal is configured to receive and electrically connect with a female terminal at the same time that the at least two parallel male terminals receive and electrically connect with female terminals.

Various aspects of this invention will become apparent to those skilled in the art from the following detailed description of the preferred embodiments, when read in light of the accompanying drawings.

DETAILED DESCRIPTION OF THE PREFERRED EMBODIMENTS

Figure 1:
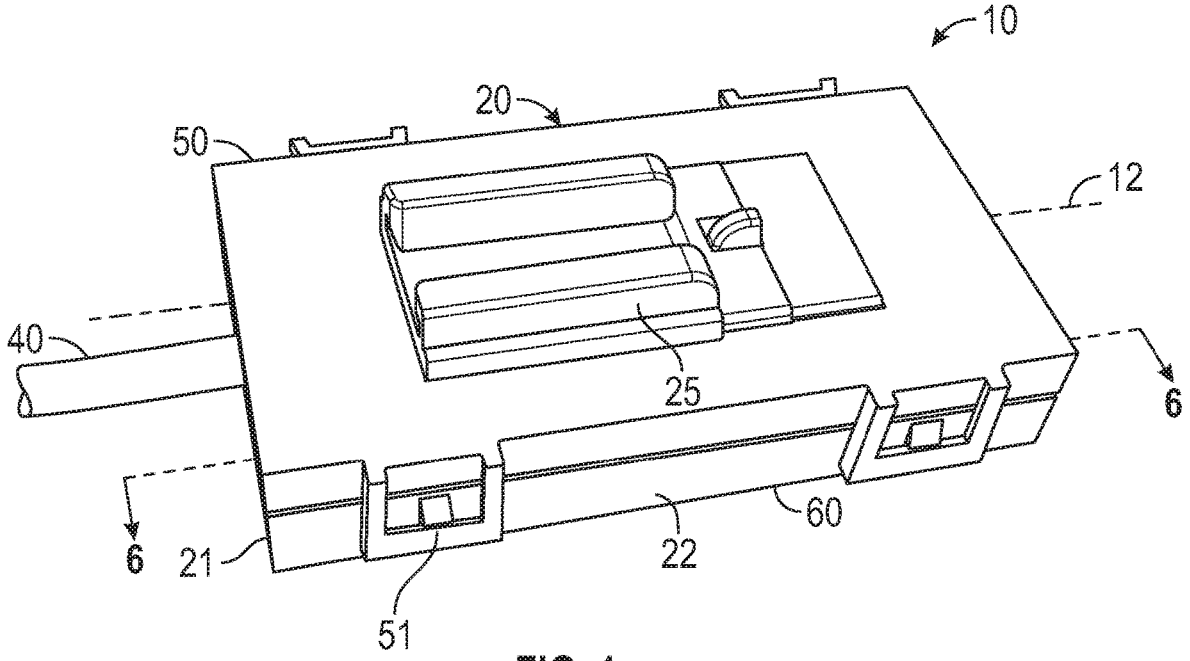
FIG. 1 is a schematic perspective view of a splice connector assembly in accordance with this invention.
Figure 2:
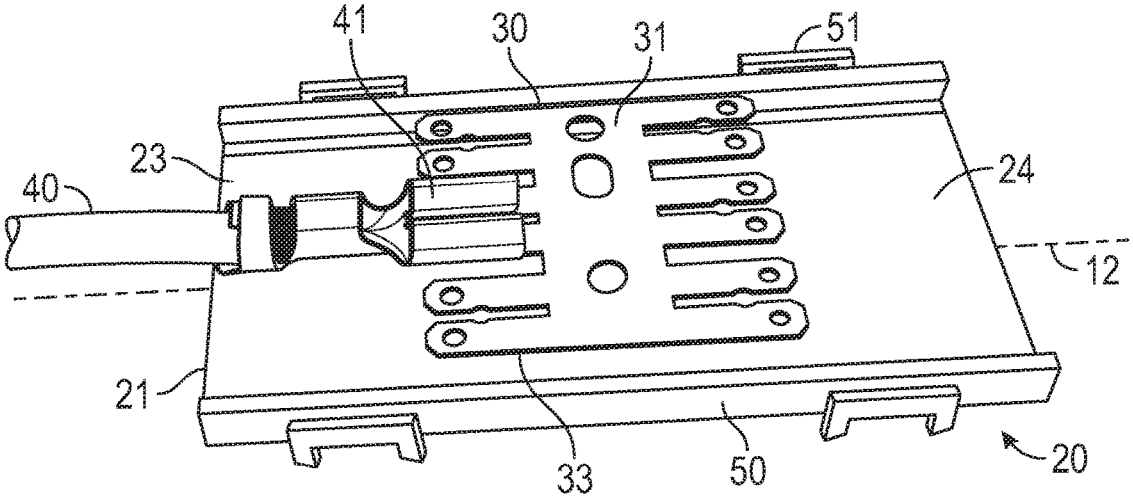
FIG. 2 is a schematic, enlarged perspective view of a portion of the splice connector assembly illustrated in FIG. 1, wherein an upper housing portion has been removed to more clearly show a bus plate.
Figure 3:
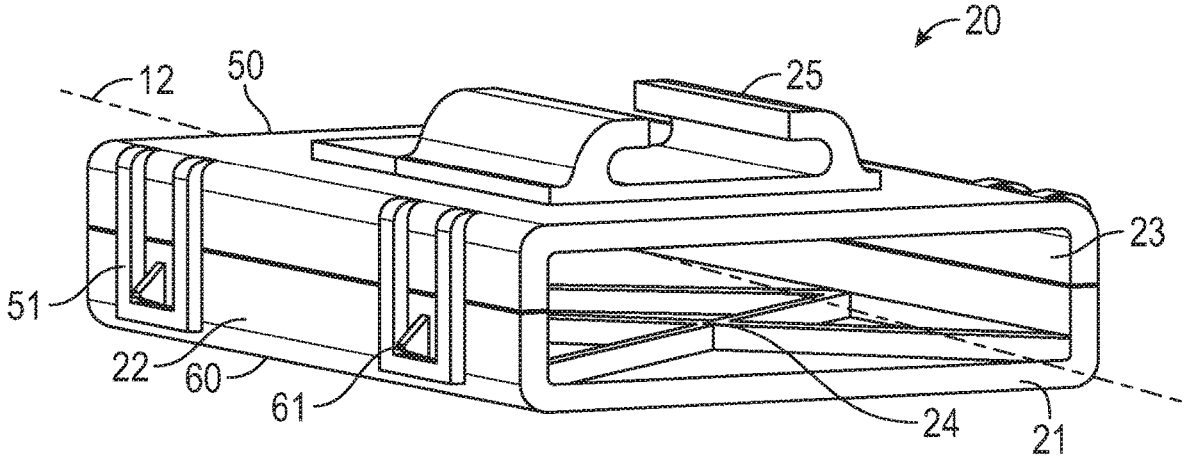
FIG. 3 is a schematic perspective view of an electrically insulated housing of the splice connector assembly in accordance with the present invention.

Referring now to the drawings, there is illustrated in FIGS. 1-3 a splice connector assembly 10, shown according to an exemplary embodiment. The splice connector assembly 10 may include an electrically insulated housing 20 and an electrically conductive bus plate 30 (see FIG. 2). The housing 20 may include an upper housing portion 50 (see FIGS. 1 and 3) and a lower housing portion 60 that engageably couple to one another to cumulatively form a generally rectangular shape. The housing 20 may be made of, for example, an electrically insulating plastic material. The splice connector assembly 10 may further include electrical cables 40 (see FIGS. 1 and 2), which may extend into the housing 20. The electrical cables 40 are configured to electrically couple a power source or output to the bus plate 30, so as to allow current to flow into and out of the splice connector assembly 10.

The housing 20 may have a generally rectangular shape when assembled, which extends along an axis 12. In other words, the housing 20 may include a pair of parallel sidewalls 22 connected by a pair of parallel end walls 21. The end walls 21 may each include an opening 23 that is configured to allow electrical cables 40 to extend into the housing 20. The electrical cables 40 may be configured as output wires and carry current away from the splice connector assembly 10. The electrical cables 40 may electrically connect to the bus plate 30 by way of female terminals 41. The female terminals 41 may be configured to receive and electrically connect to male terminals 33 of the bus plate 30. Beneficially, due to the sizing of the opening 23 of the housing 20 and the flat configuration of the bus plate 30, multiple electrical wires 40 may extend into the housing 20 through one of the other or both of the openings 23 simultaneously, allowing for a plurality of female terminals 41 to electrically connect to the male terminals 33.

The bus plate 30 is disposed within the housing 20. The bus plate 30 is flat and generally H-shaped. The bus plate 30 is configured to receive electrical cables 40 such that current may flow from the splice connector 10 to an output. The bus plate 30 may include a central connecting strip 31 extending perpendicular to the axis 12 such that the connecting strip 31 extends most or all of the way between the two side walls 22. The connecting strip 31 may include a plurality of parallel male terminals 33 extending outwardly parallel to the axis 12 from each longitudinal side of the connecting strip 31, a first set of male terminals extending in a first direction and a second set of male terminals extending in the opposite direction. The distal end of the male terminals 33 are configured to receive and electrically connect with female terminals 41.

The housing 20 may be generally hollow, such that it includes a cavity 24. The cavity 24 is configured to receive the bus plate 30. In addition, the housing 20 includes the opening 23 in each end wall 21.

The housing 20 may include a clip 25 on the upper housing portion 50. The clip 25 may be made of, for example, plastic, and is configured to provide a means of fastening the splice connector assembly 10 to any other structure. For example, the clip 25 may be configured to secure the splice connector assembly 10 in place within a compartment of a vehicle. However, while the clip 25 is shown on the upper housing portion 50, it should be appreciated that any number of clips 25 may be provided at any location or position on the outer surface of the splice connector assembly 10.

The housing 20 may include a first latch member 51 and a second latch member 61. The first latch member 51 and second latch member 61 are configured to matingly engage to secure the upper housing portion 50 to the lower housing portion 60. As shown, the first latch member 51 may be in the form of a downward extending protrusion from the upper housing portion 50 having a window that is configured to engage with the second latch member 61, of the lower housing portion 60. The first latch member 51 may be integrally formed with the upper housing portion 50 and be disposed along the sidewalls 22. Similarly, the second latch member 61 may be in the form of a corresponding protrusion, such as for example a barb, that is integrally formed with the lower housing portion 60 and is configured to be received within the window of the first latch member 51. The housing 20 is shown to include four respective pairs of latches along the sidewalls 22 with each comprising a first latch member 51 and a second latch member 61. However, while four pairs of latches are shown, it should be appreciated that any quantity of pairs of latches may be used. In addition, it should be appreciated that any other configuration of matingly engaging the upper housing portion 50 and lower housing portion 60 may be used, including other configurations of latches, snaps, or buckles.

Figure 4:
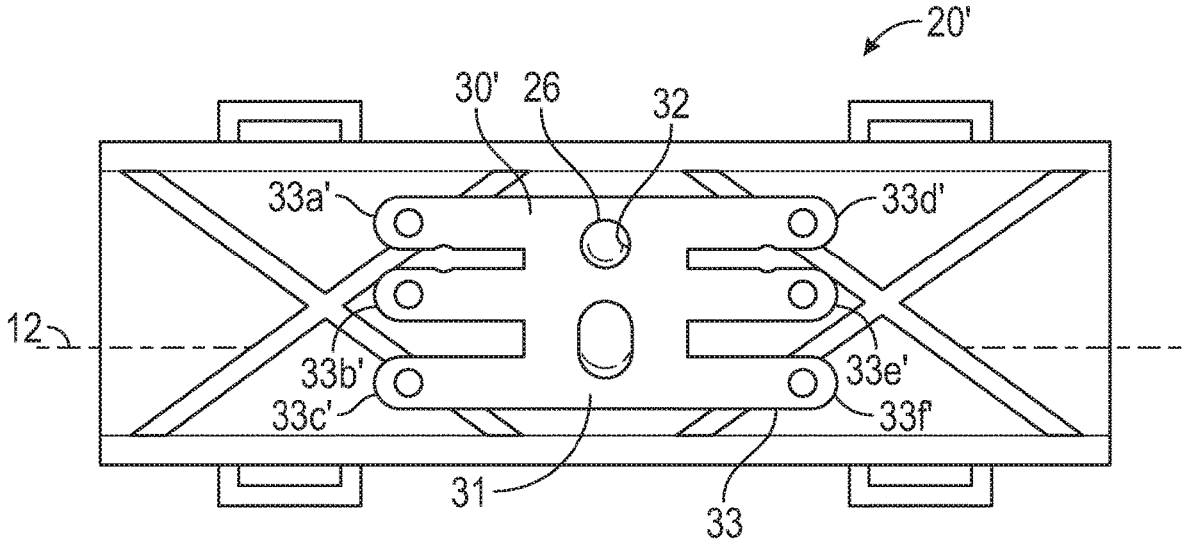
FIG. 4 is a schematic drawing of a 6-way bus plate disposed within the lower housing portion of the splice connector assembly.
Figure 5:
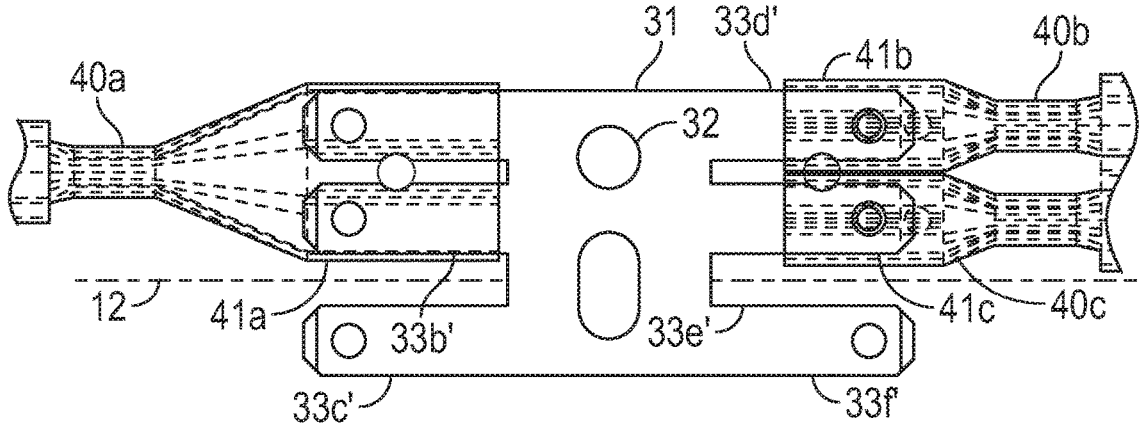
FIG. 5 is a schematic drawing of a 6-way bus plate, similar to that shown in FIG. 4, with female terminals connected to some of the male terminals of the bus plate.

Referring now to FIGS. 4 and 5, a schematic of the bus plate 30 is shown in greater detail. Specifically, the schematic shows a six-way bus plate 30' within a six-way housing 20'. While the current disclosure is intended to include a housing 20 which receives a bus plate 30 with any plurality of male terminals 33 that are configured to receive and electrically connect with any plurality of female terminals 41, the six-way bus plate 30' configuration (and twelve-way bus plate 30" configuration of FIG. 7) are described in greater detail to better examine specific features. The bus plate 30' includes a connecting strip 31 that extends perpendicular to the axis 12. The connecting strip 31 is shown to include an aperture 32. Specifically, the lower portion 60 of the housing 20' may include at least one upwardly extending positioning stud 26 that is configured to be received within the aperture 32 of the bus plate 30 to position the bus plate 30' within the housing 20'. A plurality of male terminals 33 extend outwardly parallel to the axis 12 from the longitudinal sides of the connecting strip 31. The male terminals 33 along each longitudinal side of the connecting strip 31 (a first set extending from one side and a second set of the male terminals extending from the opposite side of the connecting strip 31) are parallel to one another so as to enable female terminals 41 to engage with respective male terminals 33 without obstruction. First, second, and third male terminals 33*a*'-33*c*', respectively, may extend axially outwardly to the left from the connecting strip 31, defining a first set of male terminals; and fourth, fifth, and sixth male terminals 33*d*'-33*f*', respectively, may extend axially outwardly to the right from the connecting strip 31, defining a second set of male terminals. In addition, the spacing between the first 33*a*' and second 33*b*' male terminals and fourth 33*d*' and fifth 33*e*' male terminals is shown to be closer than between the second 33*b*' and third 33*c*' male terminals and fifth 33*e*' and sixth 33*f*' male terminals. Beneficially, such a spacing configuration between the male terminals 33 may allow for different sizes and quantities of female terminals 41 to engage with the male terminals 33. For example, a single female terminal 41 may engage with any of the male terminals 33 individually, or a wider female terminal 41 may engage with two adjacent male terminals 33, within the same set, simultaneously. Such a configuration allows for an increased and more versatile range of currents and connectors to be used with the splice connector assembly 10.

A depiction of how the female terminals 41*a*-41*c* may connect to the bus plate 30' is best illustrated in FIG. 5. The bus plate 30' includes the first 33*a*' and second 33*b*' male terminals connected to female terminals 41*a*-41*c*. Specifically, due to the spacing of the first 33*a*' and second 33*b*' male terminals, a single first female terminal 41*a* may receive and electrically connect with both the first 33*a*' and second 33*b*' male terminals simultaneously. In addition, the spacing of the fourth 33*d*' and fifth 33*e*' male terminals may have identical spacing as the first 33*a*' and second 33*b*' male terminals. However, unlike the first 33*a*' and second 33*b*' male terminals, the fourth 33*d*' and fifth 33*e*' terminals may receive and electrically connect with two individual female terminals, 41*b* and 41*c*, respectively. For example, the first female terminal 41*a* which is connected to the first 33*a*' and second 33*b*' male terminals may be a 6.3 mm terminal, and the second and third female terminals 41*b* and 41*c*, respectively, which are connected to the fourth 33*d*' and fifth 33*e*' male terminals, may each be 2.8 mm terminals. Thus, the splice connector assembly 10 of the current disclosure beneficially may allow for multiple and various sized female connectors 41 to electrically connect with multiple male terminals 33 within a compact housing 20.

Figure 6:
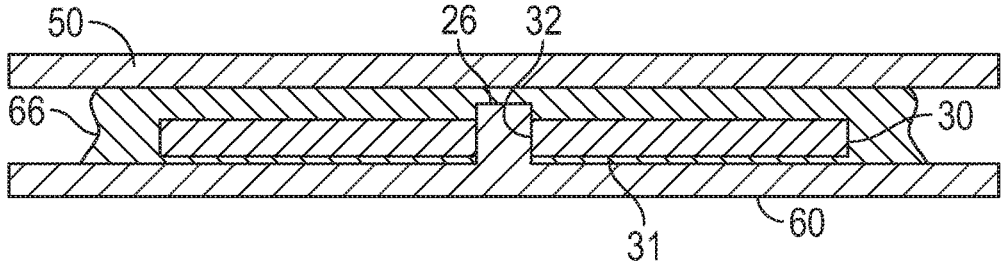
FIG. 6 is a schematic cross sectional view of the splice connector assembly of FIG. 1 taken along line 6-6.

Referring now to FIG. 6, as previously described, the splice connector assembly 10 may include at least one positioning stud 25 as a means of securing and positioning the bus plate 30 within the housing 20. Specifically, FIG. 6 depicts a cross sectional view along Section 1-1 from FIG. 1 which is intended to provide the structure and function of the positioning studs 25 in further detail. As shown, the bus plate 30 is received within the cavity 24 of the housing 20 (i.e., between the upper housing portion 50 and the lower housing portion 60). The lower housing portion 60 includes at least one upwardly extending positioning stud 25. The positioning stud 25 is configured to be received within an aperture 32 of in the connecting strip 31 of the bus plate 30. The positioning stud 25 may be an integrally formed upwardly extending protrusion, which may extend at least above a bottom surface of the bus plate 30. For example, the positioning stud 25 of FIG. 6 is shown to extend upward beyond a top surface of the bus plate 30. It should be appreciated that when the positioning stud 25 is received within the aperture 32 of the bus plate 30, the bus plate 30 may be secured in place within the housing 20. Additionally, a mastic sealant 66 may be applied in the cavity 24, which sealant 66 may improve the use of the splice connector assembly in wet areas.

Figure 7:
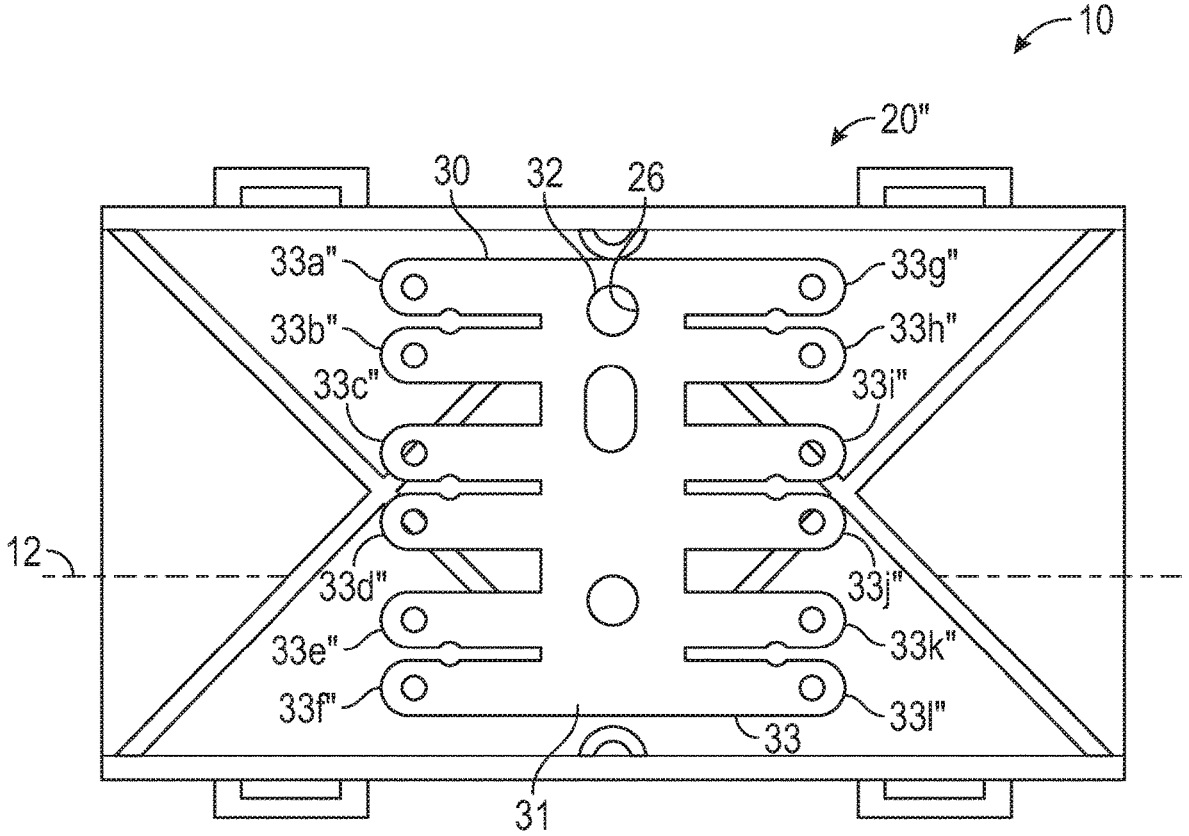
FIG. 7 is a schematic drawing of a 12-way bus plate disposed within the lower housing portion of the splice connector assembly.

Referring now to FIG. 7, a perspective view of a splice connector assembly 10 that is configured with a twelve-way bus plate 30" is shown. The twelve-way bus plate 30" and twelve-way housing 20" include substantially the same features and structure as the six-way bus plate 30' configuration shown in FIGS. 4 and 5. The twelve-way bus plate 30" is configured to allow for up to twelve female terminals (such as those shown in FIG. 5) to connect to the bus plate 30" simultaneously. The twelve-way bus plate 30" is shown to include the first through sixth male terminals 33*a*"-33*f*' extending outwardly to the left parallel to the axis 12 from the longitudinal side of the connecting strip 31 (a first set of male terminals), and the seventh through twelfth male terminals 33*g*"-331" extending outwardly to the right parallel to the axis 12 from the opposite longitudinal side of the connecting strip 31 (a second set of male terminals). Similar to with the six-way bus plate 30', the twelve-way bus plate 30" is shown to include a spacing configuration between the male terminals 33 that may allow for different sizes and quantities of female terminals 41 to engage with any of the male terminals 33 simultaneously. Specifically, as shown, adjacent pairs of male terminals 33 are shown to be spaced closer to one another, with a larger gap between each pair. For example, the first 33*a*" and second 33*b*" male terminals and third 33*c*" and fourth 33*d*" male terminals are each spaced with a smaller gap than between the second 33*b*" and third 33*c*" male terminals. Beneficially, such a configuration could allow for twelve female terminals 41 to engage with any of the twelve male terminals 33*a*"-331" simultaneously, or each of a plurality of female terminals 41 could engage with multiple adjacent male terminals 33 simultaneously.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A splice connector assembly comprising:

a housing having openings extending through opposed end walls, the opposed end walls defining an axis that is generally perpendicular to the opposed end walls; and a flat bus plate disposed within the housing, the bus plate including a connecting strip extending generally perpendicular to the axis, a first set of male terminals extending outwardly from the connecting strip generally parallel to the axis, and a second set of male terminals extending outwardly from the connecting strip generally parallel to the axis and in an opposite direction from the first set of male terminals, wherein free ends of the male terminals receive and electrically connect with female flat terminals, and wherein the female flat terminals extend into the housing into connection with the male terminals through the openings extending through the opposed end walls, wherein either:

(1) the first set of male terminals are sized and spaced such that each male terminal can receive and electrically connect with one of the female flat terminals, respectively, or such that two adjacent male terminals of the first set of male terminals can receive and electrically connect with one of the female flat terminals together; or (2) the bus plate is a six-way bus plate, such that the first set of male terminals includes three male terminals and the second set of male terminals includes three male terminals that are configured to receive and electrically connect with at least two of the female flat terminals, wherein the female flat terminals extend into the housing to connect to the male terminals through the openings on each of the end walls; or (3) the bus plate is a twelve-way bus plate, such that the first set of male terminals includes six male terminals and the second set of male terminals includes six male terminals that are configured to receive and electrically connect with at least two of the female flat terminals, wherein the female flat terminals extend into the housing to connect to the male terminals through the openings on each of the end walls.

2. The splice connector assembly of claim 1, wherein the housing includes an upper portion and a mating lower portion which cumulatively form a generally rectangular shape.

3. The splice connector assembly of claim 2, wherein the lower portion includes at least one raised positioning stud that is received within an aperture in the bus plate to position the bus plate within the housing.

4. The splice connector assembly of claim 1, wherein the housing defines a cavity within which is mounted the bus plate, and further including a mastic located within the cavity.

5. The splice connector assembly of claim 1, wherein the first set of male terminals are sized and spaced such that each male terminal can receive and electrically connect with one of the female flat terminals, respectively, or such that two adjacent male terminals of the first set of male terminals can receive and electrically connect with one of the female flat terminals together.

6. The splice connector assembly of claim 1, wherein the bus plate is a six-way bus plate, such that the first set of male terminals includes three male terminals and the second set of male terminals includes three male terminals that are configured to receive and electrically connect with at least two of the female flat terminals, wherein the female flat terminals extend into the housing to connect to the male terminals through the openings on each of the end walls.

7. The splice connector assembly of claim 1, wherein the bus plate is a twelve-way bus plate, such that the first set of male terminals includes six male terminals and the second set of male terminals includes six male terminals that are configured to receive and electrically connect with at least two of the female flat terminals, wherein the female flat terminals extend into the housing to connect to the male terminals through the openings on each of the end walls.

8. A splice connector assembly comprising:

an electrically insulated housing having openings extending through opposed end walls, the opposed end walls defining an axis that is generally perpendicular to the opposed end walls, wherein the housing further includes an upper housing portion and a lower housing portion defining a cavity; and a flat, electrically conductive bus plate received within the cavity, the bus plate including a connecting strip extending generally perpendicular to the axis, an aperture, and a plurality of axially extending, parallel male terminals extending from each longitudinal side of the connecting strip, wherein the male terminals engage with female flat terminals that enter the housing through the openings on each of the end walls wherein either:

(1) the plurality of male terminals of the bus plate are spaced such that each male terminal can receive and electrically connect with one of the female flat terminals, or such that two adjacent male terminals can receive and electrically connect with one of the female flat terminals together; or (2) the bus plate is a six-way bus plate, such that bus plate includes three male terminals extending outwardly from each longitudinal side of the connecting strip parallel to the axis and which are configured to receive and electrically connect with at least two of the female flat terminals, wherein the female flat terminals extend into the housing to connect to the male terminals through the openings on each of the end walls.

9. The splice connector assembly of claim 8, wherein the lower portion includes at least one upwardly raised stud that is received within the aperture to position the bus plate within the cavity.

10. The splice connector assembly of claim 8, wherein the plurality of male terminals of the bus plate are spaced such that each male terminal can receive and electrically connect with one of the female flat terminals, or such that two adjacent male terminals can receive and electrically connect with one of the female flat terminals together.

11. The splice connector assembly of claim 8, wherein the bus plate is a six-way bus plate, such that bus plate includes three male terminals extending outwardly from each longitudinal side of the connecting strip parallel to the axis and which are configured to receive and electrically connect with at least two of the female flat terminals, wherein the female flat terminals extend into the housing to connect to the male terminals through the openings on each of the end walls.

12. A bus plate comprising:

a connecting strip extending perpendicular to an axis;

at least two parallel male terminals extending outwardly along an axis from each longitudinal side of the connecting strip, wherein the distal end of each male terminal being configured to receive and electrically connect with a female terminal; and at least one third male terminal extending outwardly along each longitudinal side of the connecting strip that is parallel to and spaced apart from the at least two parallel male terminals, wherein the distal end of the at least one third male terminal being configured to receive and electrically connect with a female terminal of the male terminal at the same time the at least two parallel male terminals receive and electrically connect with female terminals.

13. The bus plate of claim 12, wherein the bus plate is configured to be received within a cavity of a housing having an opening on opposed end walls that are configured to receive electrical cables.

14. The bus plate of claim 13, wherein the bus plate further includes an aperture in the connecting strip that is configured to receive a positioning stud of the housing.

15. The bus plate of claim 12, wherein the at least two male terminals on each longitudinal side of the connecting strip are spaced such that each male terminal can receive and electrically connect with one of the female flat terminals, or such that two adjacent male terminals can receive and electrically connect with one of the female flat terminals together.

* * * * *